United States Patent [19]

Hardin

[11] Patent Number: 4,833,987

[45] Date of Patent: May 30, 1989

[54] AXIALLY OSCILLATING INK DISTRIBUTING ROLLER HAVING A UNITARY ROCKER FOLLOWER

[76] Inventor: Philip J. Hardin, 850 Park La., Elm Grove, Wis. 53122

[21] Appl. No.: 192,352

[22] Filed: May 10, 1988

[51] Int. Cl.[4] ..... B41L 27/16

[52] U.S. Cl. ..... 101/348; 101/DIG. 38

[58] Field of Search ..... 101/348, DIG. 14, 349, 101/350, 351, 352, 354, 355–358, 360, 361, 205–209

[56] References Cited

U.S. PATENT DOCUMENTS

| | | | |
|---|---|---|---|
| 4,509,426 | 4/1985 | Hardin | 101/348 |
| 4,672,894 | 6/1987 | Hardin | 101/348 |
| 4,756,249 | 7/1988 | Hardin | 101/348 |

*Primary Examiner*—Edgar S. Burr
*Assistant Examiner*—James Lisehora
*Attorney, Agent, or Firm*—Fuller, Puerner & Hohenfeldt

[57] ABSTRACT

An axially oscillating ink or other coating material distributing rotationally driven roller has axially spaced apart internal left and right hand threads journaled for rotating and sliding axially on a shaft. A unitary rocker-follower lever is mounted for rocking relative to the shaft about the axis of a pin or a spherical element mounted to the shaft. Opposite ends of the lever has segments of external threads formed integrally with it. The external thread segments act as internal thread followers and are caused to engage and disengage the internal threads alternately to drive the roller in opposite axial directions. The lever is made long to minimize the angle through which it rocks in which case there is only a tiny amount of movement between possible wearing surfaces on the rocker and the pin or spherical element on which the lever rocks so wear is reduced to a minimum.

13 Claims, 4 Drawing Sheets

AXIALLY OSCILLATING INK DISTRIBUTING ROLLER HAVING A UNITARY ROCKER FOLLOWER

BACKGROUND OF THE INVENTION

The invention disclosed herein is an improvement over U.S. Pat. No. 4,509,426, dated Apr. 9, 1985 and over pending patent application Ser. No. 892,901, filed Aug. 4, 1986. The entire disclosures of the patent and application are incorporated herein by reference.

U.S. Pat. No. 4,509,426 describes a basic mechanism for causing an ink roller which is included in the inker of an offset printing press to rotate and oscillate axially as a result of being driven rotationally by another power driven roller that is in tangential contact with the axially oscillating roller. In addition to be usable in a printing press, the roller described herein can also be used in a machine that applies a coating to sheet material or a continuous web of material such as paper. Concentric to the shaft inside of the roller in the cited patent there is a sleeve in which there are axially adjacent left hand and right hand internal threads. A rocking arm is mounted to the shaft for pivoting about an axis that is transverse to the axis of the shaft. At each end of the rocking arm, there is a plunger, each of which has a projection constituting a thread follower element. The arm is automatically rocked so that when the follower on one plunger engages with the left hand thread the roller will move axially in one direction while the other follower is disengaged. Upon reaching the desired limit of axial movement, the engaged follower encounters a striker which expels the follower from its cooperating thread and causes the other follower to engage the other internal thread, thereby causing the roller to instantaneously reverse its direction of axial movement.

Although the roller has distinguished itself commercially by reason of getting more uniform ink distribution in the inkers of printing presses and although it has eliminated ghosting in cases where other approaches have failed, the roller oscillating mechanism is not optimized for use in the recently inaugurated highest speed presses. For one thing, frictional forces are not minimized. These frictional forces occur where the plungers having the thread follower prongs slide along guide cylinders. The rocker arm has a sphere at each end for registering in a socket in the plunger which it drives. The sphere and socket arrangement generates some friction but of even more concern is the requirement that the parts be carefully machined and aligned to properly mate with each other. But every machining step and every instance where careful fitting is required raises the cost and complicatedness of the design. The number of moving parts and the movement of one part upon another, of course, results in many opportunities for wear to occur which portends shorter operating life for the mechanism. Although the design was completely satisfactory for use in the previous generations of presses that fed sheet material through at about 600 feet a minute, it could be predicted that the design would not be suitable for the high speed presses which have been recently and are currently being installed. The highest speed presses presently available are often operated at the web feed rate of 2,000 to 2,200 feet per minute. The problems of designing a durable oscillating mechanism can be appreciated when one recognizes that in the highest speed presses the axially oscillating roller would be required to complete something over 12,000 cycles per hour or, in other words, over 24,000 reversals per hour. A roller may move axially in the range of three-quarters of an inch to two inches at high axial speed and then reverse instantly and accelerate to full speed in the opposite direction substantially instantly. Sometimes a production run on a press can go on for 24 hours a day for a full week or even more. The number of axial reversals that a roller experiences under such circumstances is almost impossible to comprehend.

Progress in upgrading the durability of the axial oscillating mechanism is illustrated in the above-cited application Ser. No. 892,901. In the design disclosed therein, short bell cranks are used to drive the followers and a sliding link is substituted for a rocking arm. When a striker in an internal left or right hand thread struck the follower, it would be forced down and would rock its associated bell crank. This, in turn, would cause the sliding link to shift and rotate the bell crank that is engaged with the other plunger follower, thus driving it into engagement with the internal thread of opposite twist so as to cause the roller to reverse its direction of axial movement. In this design, the follower plungers had at least two thread segments formed on them. These segments had the same pitch as the left and right hand internal threads to obtain a reduction in the force per unit area between the internal threads and the follower thread segments. This design has advantages and disadvantages. The disadvantages are that it increases the number of parts used in the oscillating mechanism rather than decreases the number of parts compared to the basic patented design. The intended simplification was not achieved nor was there any reduction in assembly time nor significant extension in operating life.

SUMMARY OF THE INVENTION

The invention features an ink or coating material roller in which the new mechanism for oscillating the roller axially is comprised of only a single moving part.

Briefly stated, the oscillating mechanism is used in a roller which is driven rotationally by being in tangential contact with another roller whose axis is parallel end is driven rotationally. The roller is journaled for rotation on a shaft which is mounted to an offset printing press, for example. There are cylindrical axially adjacent sleeves inside of the roller and concentric to the shaft. One of the sleeves has a right hand helical groove or internal thread and the other has a left hand helical groove or internal thread. The internally threaded elements are similar to those which are disclosed in applicant's basic U.S. Pat. No. 4,509,426. According to the invention, a new unitary rocker-follower element is provided for alternatingly and cyclically engaging with one of the threads to drive the roller axially in one direction and then after disengaging from the one internal thread, engaging with the other to cause the roller to reverse its direction of axial movement. In operation, there are usually thousands of axial reversals per hour.

The means for engaging the left and right hand internal threads alternately is a rocking thread-follower lever which is mounted to the shaft inside of the internal threads. The rocker-follower is comprised of a lever which is mounted for rocking or pivoting on the shaft at a place intermediate of its ends. Opposite ends of the rocker-follower lever have left and right hand thread segments formed on them for properly meshing with the left and right hand internal threads in the sleeves. In one embodiment, the one-piece rocker lever rocks on a sphere secured on the shaft. In another embodiment the rocker lever rocks on a pin which is mounted to the shaft with its axis directed transversely to the axis of the shaft.

In the illustrated embodiments, the integral rocker-follower lever is shaped somewhat like a saddle having side aprons that depend along opposite sides of the shaft. The side aprons are relatively thin and are connected with or integral with a heavier body portion in which there is a socket or a bore for receiving the sphere type pivot or the pivot pin, respectively. The socket for the pivot sphere is slightly more than semicircular so as to present an opening having a diameter less than the diameter of the ball. This permits pressing the socket in the rocker-follower lever onto the sphere so that the socket wraps around more than half the diameter of the sphere in which case no other element is required for holding the saddle-like rocker lever on the shaft for executing its pivotal movements. An important feature of the design is that, although the ends of the rocker follower-lever have the thread segments swing through an arc at least sufficient to clear the thread segments on one end from its mating internal thread while the thread segments at the opposite end of the arm are engaged, yet, according to the invention, the movement of the rocker lever relative to the pivot pin or the sphere is generally on the order of one thirty-second of an inch or about 0.8 mm. Thus, the rocker lever can rock or teeter-totter millions of times without exhibiting significant wear.

How the foregoing and other objectives and features of the invention are achieved will be evident in the more detailed description of embodiments of the invention which will now be set forth in reference to the drawings.

DESCRIPTION OF PREFERRED EMBODIMENT

Figure 1:
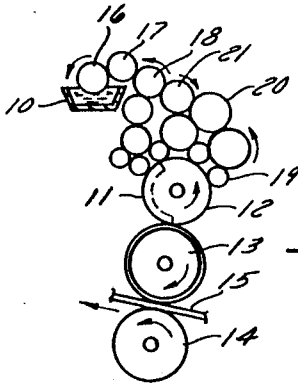
FIG. 1 is a schematic diagram of an abbreviated form of inker, such as is used in offset printing presses, comprised of plurality of ink transfer rollers, an image plate supporting cylinder, a blanket cylinder, and an impression cylinder, in which inker one or more of the improved axially oscillating rollers may be used.
Figure 3:
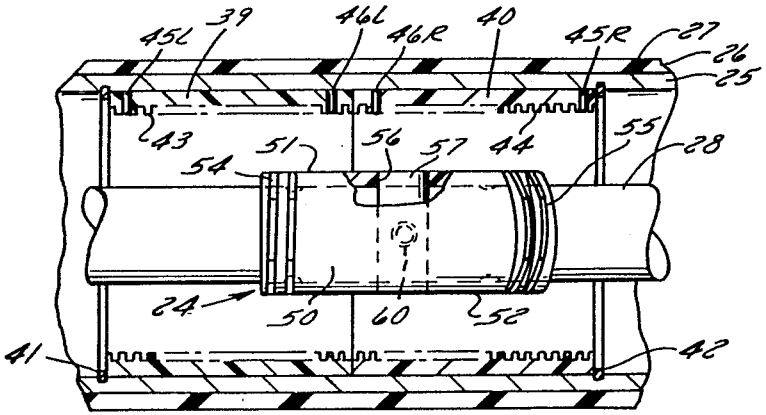
FIG. 3 is a plan view of the new unitary rocker-follower lever mounted to a shaft inside of a roller which is shown in transverse section.

FIG. 1 is a diagram illustrative of the arrangement of rollers in the inker of an offset printing press, for example, for transferring ink from a fountain 10 to a printing plate 11 mounted on a plate cylinder 12. As is typical in a lithographic offset printing press, the press includes a blanket cylinder 13 to which the inked image from the plate 11 is transferred and an impression cylinder 14 which develops pressure on a sheet 15 that is being printed by transferring the inked image from the blanket cylinder 13. The inker comprises a plurality of rollers beginning with a roller 16 that rotates in ink containing fountain 10. A ductor roller 17 swings in and out of tangential contact with fountain roller 16 and begins the process of transferring ink from roller 18 through a series of rollers and finally to the form rollers 19 which coat with ink those areas of the image plate 11 which attract ink and leave uncoated those areas which repel ink because of having a film of moisture on them.

One or usually more rollers in the inker may be adapted for oscillating axially to thereby induce uniform distribution of ink on contacting rollers and, of course, on the ink attracting areas of the image plate. By way of example and not limitation, roller 20 in FIG. 1 may be one of the rollers which oscillates axially within limits he improved oscillating roller 20 described herein needs no drive for rotating it other than another rotationally driven roller, such as roller 21, which is in tangential contact with driven axially oscillating roller 20. The force for oscillating the roller axially is derived from the rotational force applied to the periphery of the oscillating roller and this force is small where the automatic oscillating mechanism is contained inside of the roller itself according to the invention. It is, of course, well known that to print images satisfactorily the ink coating must be even on the distribution rollers and on the image plates. No means for applying moisture to the moisture attracting area of the image plate is shown but it will be understood that such means would be used in the press.

Refer now to FIGS. 2–7 for a description of the improved oscillator mechanism which is comprised of only one moving part, namely, a unitary rocker-follower which is indicated generally by the numeral 24.

Figure 2:
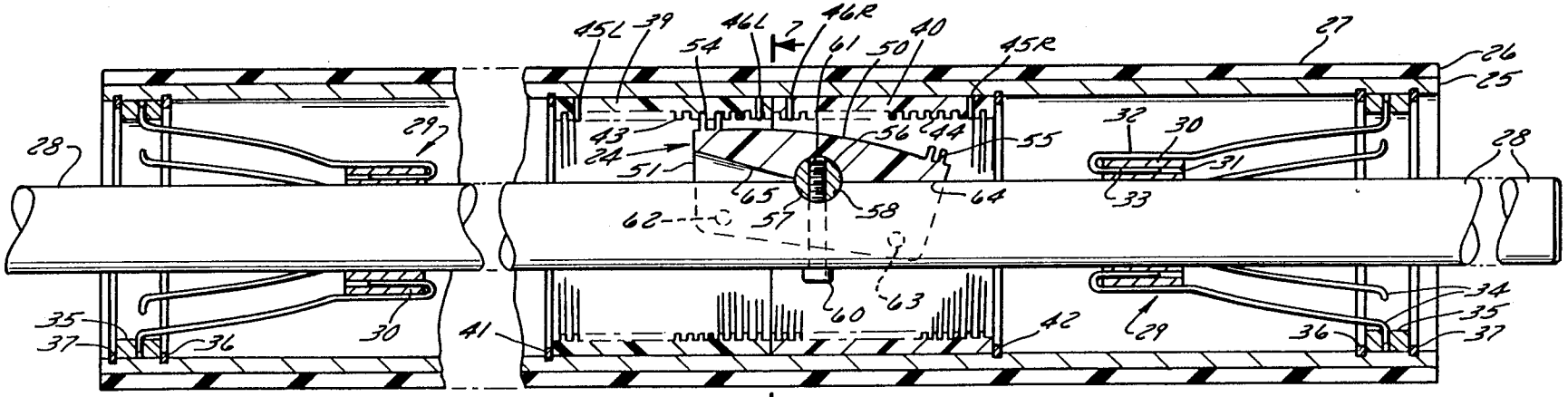
FIG. 2 is a vertical longitudinally extending section of the new axially oscillating roller and, as depicted, the roller is presently translating axially to the right.

FIG. 2 illustrates that the ink roller is comprised of a hollow cylinder which may be metal or a rigid plastic material. This particular roller has a coat or sleeve of any suitable resilient material 26 which may be rubber or a polymer such as polyvinyl chloride, for example. The periphery 27 of the axially oscillating roller in FIG. 2 receives ink from a tangential contacting roller, in the inker of FIG. 1, which also drives the oscillating roller 25 axially. The roller construction described so far is known per se.

The roller in FIG. 2 rotates and oscillates on a shaft 28 which is mounted to the printing press within the confines of the inker of FIG. 1. When the shaft 28 is used in conjunction with a roller having the axial oscillation capability described herein, the shaft can either be mounted for rotation on the press or it can be clamped to the press. For the sake of brevity and simplicity, it will be assumed that shaft 28 is fixed in this case. In the illustrated embodiment of the roller, self-aligning bearings such as the one indicated by number 29 are used. Bearings of this type are described in co-pending application Ser. No. 942,550, filed Dec. 16, 1986, now U.S. Pat. No. 4,756,249, which is owned by the inventor in this application. Similar bearings are used at each end of the roller so only the one at the right end in FIG. 2 will be described. The type of bearing selected for use in the roller comprises a bushing 30 containing a plurality of axial holes such as the one marked 31. A plurality of springy wires 32 have their corresponding ends 33 bent in hairpin fashion and these ends are inserted in their respective holes 31. Opposite ends 34 of the wires are bent at nearly ninety degrees and these ends are anchored in a collar 35 which fits tightly in roller cylinder 25 and is retained against axial movement by snap rings 36 and 37.

FIG. 2, for example, shows that the mechanism for oscillating the ink roller axially comprises two sleeves 39 and 40 fixed in the roller between snap rings 41 and 42. These sleeves may be composed of a material having high lubricity such as nylon impregnated with molybdenum sulphide. Sleeve 39 contains an internal helical groove or square thread 43 and sleeve 40 contains an internal helical groove or square thread 44. The internal threads twist oppositely. One thread may be a left hand thread and the other a right hand thread. To facilitate explanation, it will be assumed that internal thread 43 is a left hand thread and internal thread 44 is a right hand thread. It will also be assumed in this embodiment that the roller is rotating in a clockwise direction when viewed from its right end in FIG. 2 when the press is running in its normal direction. It will be evident, however, that the oscillating mechanism can effect axial oscillation of the roller regardless of the direction in which the roller rotates.

There are two striker pins 45L and 46L angularly spaced apart from each other and fixed in the left hand internal thread 43. The rounded tips of the striker pins are flush with the thread. Right hand internal thread 44 also has two striker pins, 46R and 45R, similarly fixed flush with the threads. Outermost striker pins 45L and 45R are involved in switching or reversing the axial direction of roller 25 when the roller is being rotated clockwise as viewed looking toward the right end of the roller in FIG. 2. The innermost pair of strikers 46L and 46R are involved with reversing the direction of axial movement of the roller when the roller 25 is being rotated counterclockwise as viewed from the right end in FIG. 2.

Figure 4:
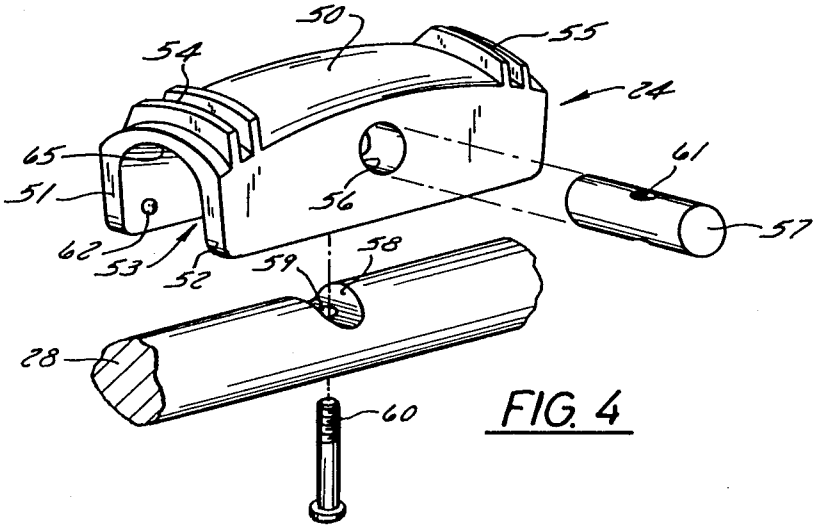
FIG. 4 is an exploded view of the new one-piece or unitary rocker-follower lever in conjunction with a portion of the shaft on which the lever is mounted on a pivot pin as shown.

Refer now to FIG. 4 for a general description of the new unitary rocker-follower lever 24. The lever is generally u-shaped having a nominal wall or base which has legs or side walls 51 and 52 formed integrally on opposite sides of the base. The side walls 51 and 52, in conjunction with base 50, define a channel 53 which allows the rocker-follower lever to be fitted on roller shaft 28 like a saddle. The width of the channel between side wall 51 and 52 is nominally the same as the diameter of the shaft 28. The lever 24 has two groups of square follower thread segments 54 and 55 formed integrally with it. In some models, not shown, each of the groups can include more than the two thread segments shown in this case. The follower thread segments in group 54 are left hand square threads in this example and they have the same pitch as the internal threads to facilitate proper mating with the left hand internal threads 43 in the roller. The follower thread segments in group 55 are right hand threads for mating with the right hand internal threads 44 in the roller. The unitary rocker-follower lever 24 is formed as one piece by molding or die casting of a synthetic resin material that has lubricity but the lever can also be formed of metal if desired.

The unitary rocker-follower lever 24 is mounted for tilting or rocking in teeter-totter fashion on shaft 28 in response to being actuated by one or the other pairs 45L and 45R or 46L and 46R of striker pins in the internal threads of the roller. In the FIG. 2 embodiment, the unitary rocker-follower lever 24 has a laterally extending hole 56 which constitutes a bearing. A pivot pin 57 is dimensioned to fit snugly in hole 56. When rocker-follower lever 24 is caused to saddle shaft 28, pivot pin 57 registers in a semicircular groove 58 in shaft 28. There is a hole 59 passing through shaft 28 in line with groove 58 for receiving a threaded bolt 60 with a little clearance. Pivot pin 57 has a threaded hole 61 in it. The threads on bolt 60 screw into the threads 61 in the pivot pin to hold the pin in groove 58. The arrangement permits the lever 24 and follower thread segments 54 and 55 to rock on pivot pin 57 to alternately engage and disengage the follower threads with the internal threads 43 and 44, respectively, in the roller to bring about axial reversals of the roller.

One of the detents 62 for tentatively holding lever 24 in one tilted position or the other is visible in FIG. 4. Another detent 63 is indicated in FIG. 2 and other figures also. These detents can be small balls set in a side wall 51 of the lever 24 with about one-half of their periphery protruding or they can be the rounded ends of metal pins extending through side walls 51 or 52 or they can be semicircular dimples molded on the side wall 51, for instance. As shown in FIG. 2, when lever 24 is tilted to its clockwise limit, detent 63 is slightly below the horizontal center plane of shaft 28 which means that to get to that position the detent had to pass across the widest part, namely, the diameter of the shaft 28. This caused side wall 51 of the rocker-follower lever 24 to slightly flex outwardly from the shaft. As the detent dimple moves to below the horizontal center plane of the shaft, the side wall flexes inwardly again toward the shaft so the detent is below the shaft center and is retained with a slight force against tilting if there were any tendency for the unitary rocker-follower lever to tilt inadvertently when a thread segment group is engaged with an internal thread to drive the roller axially. Detent 62 performs the holding function just described when lever 24 is tilted oppositely as in FIG. 5. The detents are more important in models, not shown, in which shaft 28 is sometimes driven rotationally in which case the rocker-follower lever rotates with the shaft so the lever might be pivoted by centrifugal force.

FIG. 2 shows the roller 25 translating axially to the right at the present time, assuming that the roller is rotating clockwise as viewed from the right end of this figure. The unitary rocker-follower lever 24 is tilted and its interior beveled stop surface 64 has stopped against shaft 28. The left hand follower thread segments 54 on the lever 24 are engaged with the left hand internal thread 43, and since the roller 25 is driven rotationally by a tangentially contacting roller, not shown in FIG. 2, the roller is moving axially to the right. An important feature of the unitary rocker-follower is that when it is tilted as in FIGS. 2 and 3, the follower thread segments 54 are concentric to the internal thread 43 and to shaft 28 about which the roller rotates. At this time, the other thread segments 55 are not concentric to the roller. Of course, if the rocker-follower lever 24 tilts to its counterclockwise limit, thread segments 55 become concentric with the shaft and the right hand internal threads 40. A benefit of the engaged thread segments being concentric to the internal thread is that the force developed between the internal thread 43, for example and the external follower thread segment 54 is directed solely horizontally so there is no significant radially inwardly directed component of force developed that would have a tendency to tilt the rocker-follower lever 24 out of engagement with its mating internal thread 54.

In FIG. 2, the roller 25 will continue rotating and shifting axially to the right along shaft 28 until the leading thread segments 54 encounter striker pin 45L in the left hand internal thread. This causes the unitary rocker-follower lever 24 to tilt counterclockwise until its beveled interior stop surface 65 comes to a stop against shaft 28 at which time the right hand thread segments 55 on the lever 24 become fully engaged with the right hand internal threads 44 so the roller will start to now move axially in the opposite direction, that is, to the left as is happening in FIG. 5. Detent 62 is now below the center horizontal plane of the shaft to prevent the threads from disengaging if for some reason there was a tendency to do this.

Figure 5:
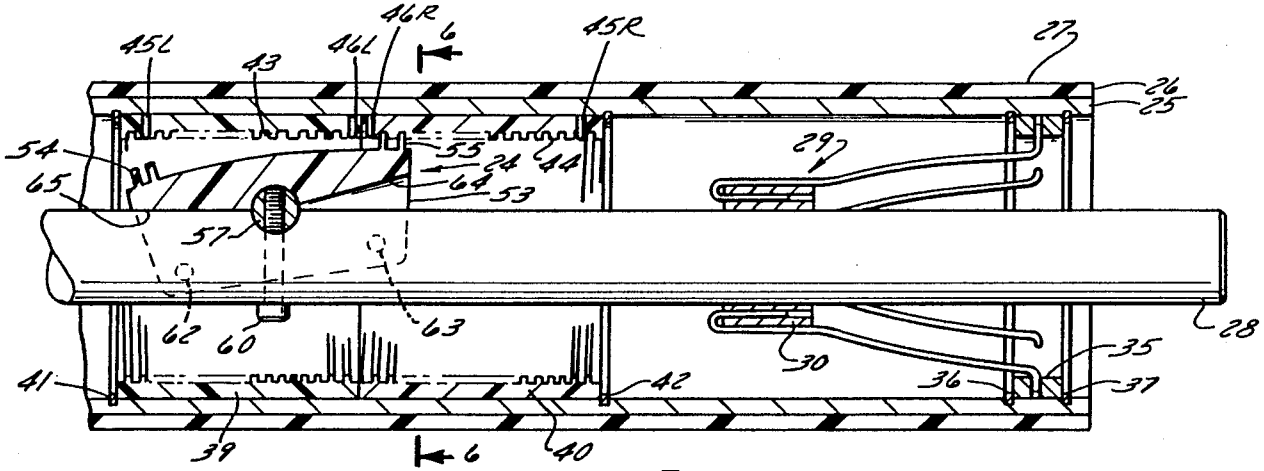
FIG. 5 is a view of the roller oscillating mechanism which is similar to FIG. 2 except that the unitary rocker-follower lever in FIG. 5 is tilted to engage the opposite internal thread from FIG. 2 so that the roller has now completed moving axially to a leftmost limit.

In FIG. 5 right hand rocker-follower thread segments 55 are engaged with and following in right hand internal thread 44. After several revolutions of the roller outer striker pin 45R will strike the leading segment of group 55 in which case the rocker-follower 44 will tilt and engage the left hand thread segments 54 with left hand internal thread 43 so the roller will move to the right again as in FIG. 2.

Figure 6:
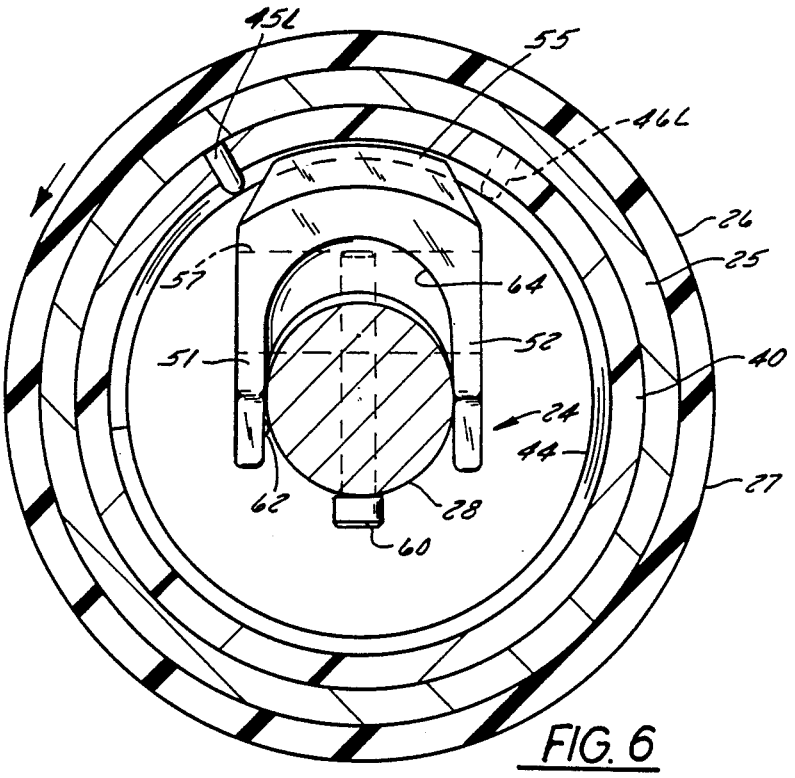
FIG. 6 is a transverse section through the roller taken on a line corresponding to 6—6 in FIG. 5.
Figure 7:
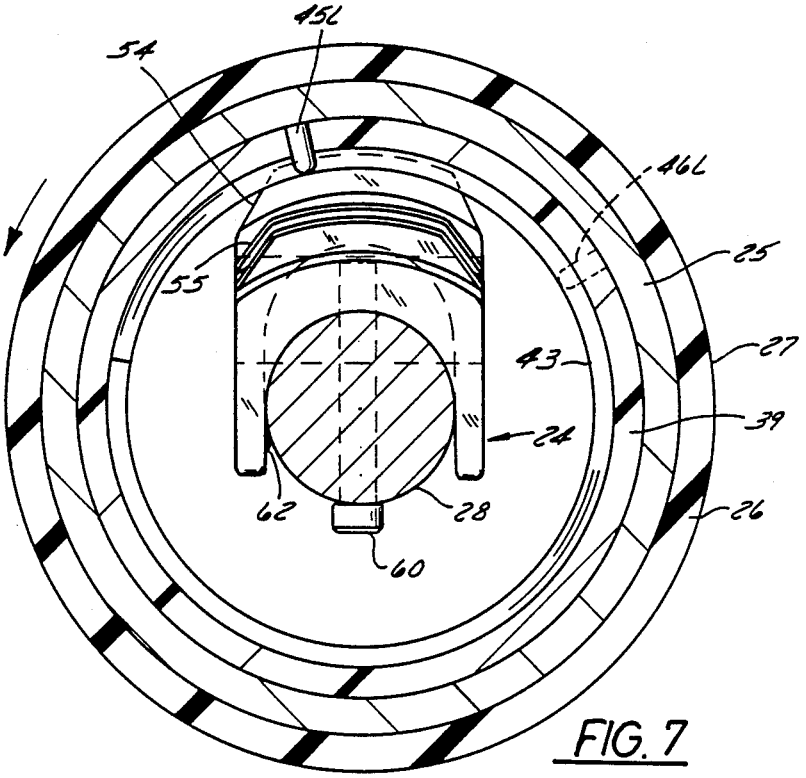
FIG. 7 is a transverse section through the roller taken on a line corresponding to 7—7 in FIG. 2.

FIG. 6 shows the roller 25 moving axially away from the observer as is the case if the roller is viewed in the direction of the arrows 7—7 in FIG. 2 from which direction the roller would appear to be turning counterclockwise about the shaft 10. Thus, striker pin 45L in the left hand internal thread 43 will, in due course, strike the axially outermost left hand thread segment 54 to cause lever 24 to tilt from its FIGS. 2 and 3 position to its FIG. 5 position. In FIG. 7, the tilt is in progress since striker pin 45L has pushed along the beveled edge of a thread segment 54 and is riding the curved part of the thread segment route to drive the end of the lever 24 downward onto shaft 28. Striker pin 46L, which appears in the background in FIGS. 6 and 7 is not involved in tilting the lever 24 when the roller is rotating counterclockwise as viewed from its right end in FIGS. 2 and 3. Striker pin 46L functions together with striker pin 46R to tilt the lever 24 at the opposite axial limits of roller travel when the roller is being driven counterclockwise as viewed from its right end in FIGS. 2 or 3.

Figure 9:
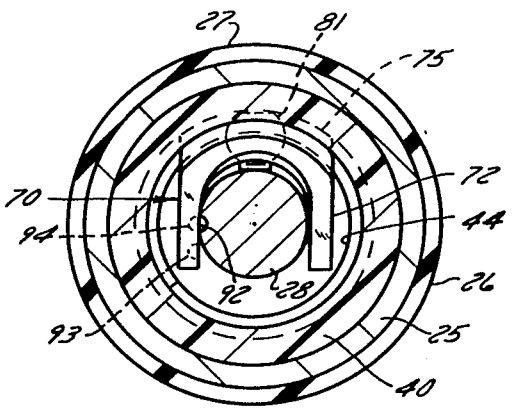
FIG. 9 is a transverse section taken on a line corresponding to 9—9 in FIG. 8.
Figure 8:
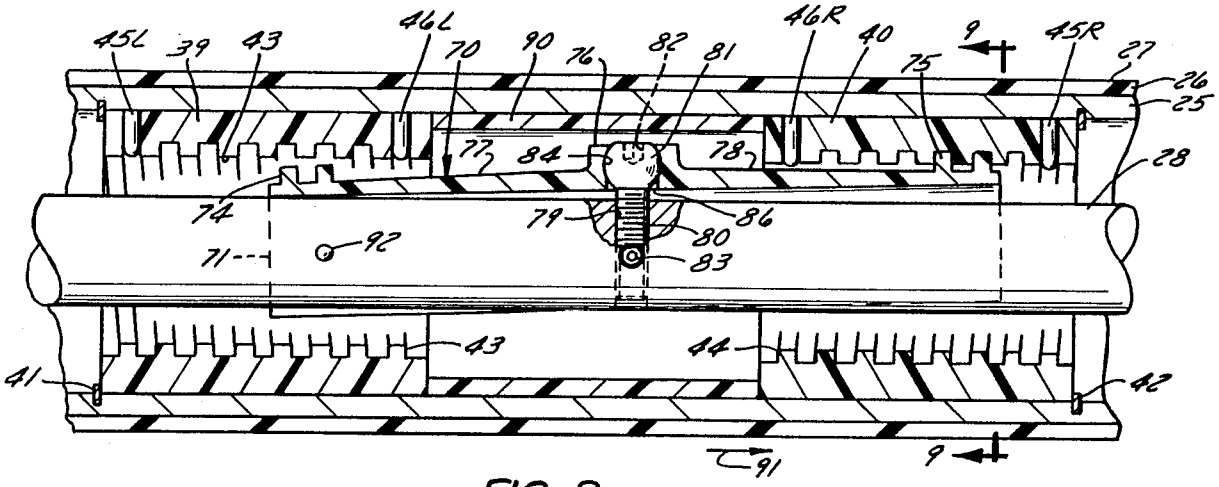
FIG. 8 is a vertical longitudinally extending section of an alternative embodiment of the new unitary rocker-follower lever concept.
Figure 10:
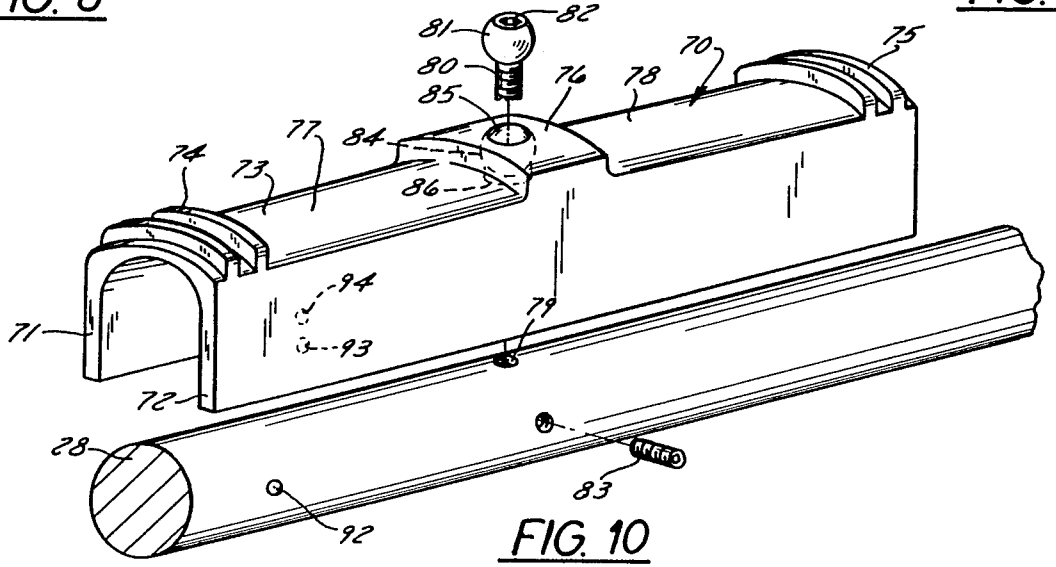
FIG. 10 is a perspective view of the unitary rocker-follower lever depicted in the FIG. 8 embodiment.

FIGS. 8–10 depict an alternative embodiment of the axial oscillator which has further improvements over the FIGS. 2–7 embodiment and can be considered the preferred embodiment. In this embodiment there is only one moving part again, namely, a unitary rocker-follower lever which, because of some differences from the previously discussed embodiment, is designated generally by the new reference numeral 70. Parts in the FIGS. 8–10 embodiment which are similar to parts in the previously discussed embodiment are given the same reference numerals As can be seen best in FIG. 10, unitary rocker-follower lever 70 has a generally u-shaped configuration defined by opposite side walls 71 and 72 and a top wall 73 having a internal semicircular shape. There are left hand follower thread segments 74 on one end of lever 70 and right hand follower thread segments 75 on the other end. There is a boss 76 formed centrally of the top 73 of the lever. A tubular spacer 90 between internally threaded sleeves 39 and 40 provides clearance so the roller can shift axially without being interfered with by the boss. The external top surfaces 77 and 78 taper downwardly away from the boss 76 to the thread segments 74 and 75, respectively, so that these surfaces become parallel to and clear the internal threads 44 and 43 when lever 70 is tilted one way or the other to engage follower thread segments 75 with right hand internal thread 44 or follower thread segment 74 with the left hand internal threads 43. Roller 25, resilient roller sleeve 26, internal threaded sleeves 39 and 40, internal left and right hand square threads 43 and 44, striker pins 45L, 46L, 45R, 46R and shaft 28 in the FIGS. 8–10 embodiment are the same as in the FIGS. 2–8 embodiment Referring to FIG. 10 again, there is an internally threaded hole 79 through shaft 28. A threaded post 80 screws into this hole. The post has a spherical part 81 formed on it or made a part of it by other means. The sphere 81 has a polygon socket for being engaged with a similarly shaped wrench, not shown, for screwing the post 80 into threaded shaft hole 79. A set screw 83 is threaded into shaft 28 for biting into post 80 to prevent the post from changing the amount by which it extends above shaft 28 once the post is turned into the shaft to place the spherical element 81 at the desired distance from shaft 28.

Boss 76 on unitary rocker-follower lever 70 has a spherical socket 84 in it. The top of the spherical socket 84 has a circular hole 85 and the bottom of the socket has a corresponding circular hole 86. The diameters of the holes 85 and 86 are a little smaller than the maximum diameter of the spherical element 81. Thus, to mount the unitary rocker-follower lever 74 for pivoting or tilting in either direction relative to shaft 28, the post 80 is screwed into shaft 28 and locked against turning by tightening set screw 83. The rocker-follower lever 70 is then made to overlay shaft 28 like a saddle with the undersized bottom hole 86 of the spherical socket resting on top of the spherical element 81. A downward force is then applied on the centrally located boss 76 so the undersized hole is caused to be forced over the full diameter of the spherical element 81 in which case the element fully enters the spherical socket 84 and a good pivotal connection for the rocker-follower lever 70 is formed. The fact that the unitary lever 70 is made of a synthetic resin material that not only has lubricity but also has some resiliency allows the bottom hole 86 in the spherical socket 84 to snap over the spherical element 81.

An important advantage in the FIGS. 8–10 embodiment resulting from mounting the lever 70 on the shaft by way of a threaded post 80 is that the same rocker-follower lever 70 can be used for rollers having several different diameters which then will also have internal left and right hand threads of different diameters. All that is necessary to adjust for different size rollers is to turn the threaded post 80 in or out of the shaft to position the spherical element 81 closer to the shaft or nearer to it so that the follower thread segments will engage and extend to the routes of the internal left and right hand threads when the lever 70 is tilted to its limits in either direction.

FIGS. 8 and 9 show the rocker-follower 70 mounted to the shaft 28. Spherical element 81 is nested in spherical socket 84. In addition to providing clearance for boss 76, spreading the internally threaded sleeves 39 and 40 apart with tubular spacer 90 allows for using a longer lever 70 which means that the thread segments and internal threads can be cleared after engagement with the lever 70 rocking only through a very small angle. It will be evident that when the lever 70 is tilted between limits, the internal surface of spherical socket 84 will make very little movement relative to the external surface of spherical element 81 so that wear between the socket surface and spherical element is, for all practical purposes, eliminated.

For the sake of illustrating that the new oscillator mechanism can oscillate the roller axially when the roller is rotating in either direction, it will be assumed in FIG. 8 that the roller is rotating counterclockwise when viewed from its right end. The right hand follower thread segments 75 in FIG. 8 are presently engaged with internal right hand thread 44. Since the roller is rotating counterclockwise, internal threads 44 are backing off of thread segment 75. Thus, the roller is moving axially to the right as indicated by arrow 91. After several roller revolutions, the right hand thread segments 75 will be struck by an inner striker pin 46 R. This will cause the unitary rocker-follower lever 70 to tilt to its clockwise limit and to be arrested by landing on shaft 28. At the same time, the left hand follower thread segment 74 will engage with internal left hand threads 43. Then, the roller 25 will start moving to the left or opposite of the direction in which the arrow 91 is pointing.

Refer to FIG. 10 again. Observe that there is a small steel sphere 92 set in shaft 28. Ball 92 is used for a detent There are two dents 93 and 94 on the inside of wall 72 of lever 70. When lever 70 is tilted to its counterclockwise limit as is the case in FIG. 8, sphere 92 will register in dent 94 and tend to stabilize the lever 70 against inadvertent tilting. When the lever 70 tilts to its clockwise limit, sphere 92 registers in dent 93 of the lever to thereby stabilize it. In FIG. 9, the detent sphere 92 is registered in dent 94. The dents are easily formed. All that is involved is to have the steel sphere 92 in place on shaft 28 when the lever 70 is assembled in a fashion to saddle on the shaft 28. The lever is then tilted to one of its limits, such as its counterclockwise limit and then the outside surface of wall 72 of the lever is struck with a hammer or the like. Since the material is somewhat resilient, wall 72 flexes inwardly somewhat and the dent 94 is formed by sphere 92. The lever is then tilted to its clockwise limit and struck again to form dent 93.

As mentioned earlier, in some cases, the shaft 28 is adapted to be driven rotationally for the purpose of changing the axial oscillation speed. It will be evident that if shaft 28 and the thread segments on it are driven rotationally at the same angular speed and direction as the roller, no oscillating force will be developed. Usually, however, shaft 28 might be rotated at a relatively small percentage of the rotational speed of the roller to reduce oscillation speed by a corresponding amount. It is when the shaft 28 is rotating that the detents in the earlier described embodiment and the FIGS. 8–10 embodiment become important because some centrifugal force is developed under these circumstances which could disengage the thread segments from the internal threads. The detents overcome this possibility.

Although illustrative embodiments of the unitary rocker-follower lever have been described in detail, such description is intended to be illustrative, rather than limiting, for the invention may be variously embodied and is to be limited only by interpretation of the claims which follow.

I claim:

1. A roller for distributing ink and other coating substances, including:

a shaft, cylindrical roller means and bearing means supporting said roller means on said shaft for rotating and oscillating axially, means defining axially arranged right hand and left hand internal threads in said roller means concentric to said shaft, axially spaced apart follower means mounted to said shaft for being moved into and out of engagement with said left hand and right hand internal threads alternately to cause said roller to oscillate in alternate axial directions, means for moving said follower means, respectively, into and out of engagement with said left and right hand internal threads in response to said roller reaching axial limiting positions, and the improvement wherein:

said follower means and means for moving said follower means are constructed as a unitary rocker-follower lever having opposite ends and having at least one external left hand follower thread means at one end and at least one external right hand follower thread means at the other end for respectively engaging said left and right hand internal threads alternately, said follower thread means being integral with said lever to drive said roller in opposite axial directions, and means for mounting said unitary rocker-follower lever to said shaft intermediate the ends of said lever for rocking said lever about an axis, generally transverse to the shaft for moving said external thread means into and out of engagement with said internal threads.

2. The roller according to claim 1 wherein said means for mounting said rocker-follower lever for rocking comprises a pin means mounted to said shaft with its axis directed transversely to the axis of said shaft, said lever having a bore whose axis is transverse to said shaft when said lever is mounted on said shaft, said pin means extending through said bore for the lever to rock on said pin means.

3. The roller according to claim 2 wherein there is a recess in the periphery of said shaft and said pin means is set in said recess, said pin means having a threaded hole transverse to the axis of the pin means, said shaft having a diametrical hole extending into said recess, and threadedbolt means extending through said hole in the shaft and engaged with said threaded hole in the pin means to secure the pin means to the shaft.

4. The roller according to claim 1 wherein said rocker-follower lever is comprised of side walls having substantially parallel facing surfaces and a nominal top wall joined integrally with the side walls to define an interior of said lever having a generally u-shaped configuration, the distance between said side walls being about equal to the diameter of said shaft for said rocker lever to saddle said shaft, detent elements protruding from the inside of at least one of the side walls of said lever means, respectively, on opposite sides of said transverse axis for rocking the lever, said detents being positioned such that when the external thread at one end of the lever and on one side of said transverse axis is rocked into engagement with an internal thread, the detent element on the other side of said axis will have passed over the diameter of the shaft to a position below said diameter to tentatively hold said lever against tilting.

5. The roller according to claim 1 wherein said rocker-follower lever is comprised of side walls having substantially parallel facing surfaces and a nominal top wall joined integrally with the side walls to define an interior of said lever having a generally u-shaped configuration, the distance between said side walls being about equal to the diameter of said shaft for said rocker lever to saddle said shaft, a detent element comprising a small metal sphere set in a side of the shaft, two dents on the inside of a side wall of the lever, the dents being spaced apart and along an arc generated from the axis about which said lever rocks, the detent sphere being positioned to lie on the arc such that then said lever is rocked to engage one external follower thread said detent sphere registers in one dent and when said lever is rocked to engage the other external thread said detent engages in the other dent to tentatively hold said lines against rocking.

6. The roller according to claim 1 wherein said external follower threads are formed on opposite ends of said lever relative to the transverse axis about which the lever rocks such that said external follower threads become concentric to the axes of said internal threads when said internal and external threads are engaged.

7. The roller according to claim 1 wherein said external follower threads are segments of a helical thread.

8. The roller according to any one of claims 1, 5, 6 or 7 wherein said means for mounting said rocker-follower lever for rocking comprises:

a spherical element mounted to said shaft, said lever having a spherical socket positioned intermediate of said follower threads at opposite ends of the lever, said spherical element being registered in said spherical socket for said lever to rock on said element.

9. The roller according to claim 8 including a threaded post means on which said spherical element is disposed, said shaft having a threaded hole in which said post means is turnable to adjust the radial distance of said spherical element from said shaft for said rocker-follower lever to be adaptable for use with rollers having internal threads of various diameters.

10. The roller according to claim 1 wherein said unitary rocker-follower lever is comprised of side walls having substantially parallel facing surfaces and a nominal top wall joined integrally with said side walls to define an interior of said lever having a generally u-shaped configuration, the distance between said side walls being about equal to the diameter of the shaft for the rocker-follower lever to saddle the shaft, said means for mounting said rocker-follower lever to said shaft comprising a threaded post means having a spherical element at one end and said shaft having a threaded hole in which said post means is turnable to adjust the distance of said sphere from said shaft, said top of said lever containing a spherical socket having an opening presented to said interior of the lever, the size of said opening being smaller than the diameter of said spherical element but yieldable enough for said socket to be pressed onto said element so said lever rocks on said spherical element.

11. The roller according to claim 10 wherein said follower thread means are segments of a helical thread.

12. The roller according to claim 10 including a pad formed integrally with said nominal top wall of said lever midway between said external thread means, said spherical socket being formed in said pad, said means defining said right and left hand internal threads being spaced apart axially to define a free space in conjunction with said lever and said roller, said pad extending into said space and said space providing clearance for said roller to move axially relative to said pad.

13. The roller according to any one of claims 10, 11 or 12 including a detent element fixed in said shaft and protruding therefrom, and a pair of dents formed on the interior of one of said side walls facing said shaft and detent, said recesses being arranged on an arc generated from the axis on which said lever rocks so said detent element is engaged by one of the dents when said lever is rocked in one direction to engage an external follower thread means with an internal thread and the other of said dents is engaged with said dent element when said lever is rocked in the other direction to engage the other external follower thread with the other of said internal threads so as to hold said lever tentatively when rocked in either direction.

* * * * *